United States Patent [19]

Sanchez

[11] 4,203,685

[45] May 20, 1980

[54] AUTOMOTIVE VEHICLE SPEED ARRESTOR

[76] Inventor: Richard E. Sanchez, 8548 Manatee St., Downey, Calif. 90240

[21] Appl. No.: 903,077

[22] Filed: May 5, 1978

[51] Int. Cl.[2] ..... E01F 13/00

[52] U.S. Cl. ..... 404/6; 49/263

[58] Field of Search ..... 404/6, 7, 9, 12, 15, 404/71; 49/262, 263

[56] References Cited

U.S. PATENT DOCUMENTS

| | | | |
|---|---|---|---|
| 1,357,860 | 11/1920 | Goodrum | 404/15 X |
| 1,661,242 | 3/1928 | Truxal | 404/12 |
| 1,688,409 | 10/1928 | Campbell | 404/12 |
| 2,034,391 | 3/1936 | Hall | 404/16 |
| 2,666,373 | 1/1954 | Mattson | 404/16 |
| 2,725,958 | 12/1955 | Porter | 404/6 X |
| 2,935,162 | 5/1960 | Lindsay | 404/6 X |
| 3,052,248 | 9/1962 | Reuter | 404/7 X |
| 3,636,829 | 1/1972 | Palmer | 404/7 |
| 4,012,156 | 3/1977 | Turner | 404/15 |

*Primary Examiner*—Nile C. Byers, Jr.
*Attorney, Agent, or Firm*—George J. Netter

[57] ABSTRACT

The speed arrester is an elongated member having a generally semi-circular cross-section and a lower flat surface secured to the roadway, parking lot or other surface by an adhesive material. The item is molded from an elastomeric plastic having substantial rigidity and yet being capable of withstanding repeated flexing from automotive vehicles passing thereover and returning to its original shape. A pair of elongated open channels act to increase the resiliency of the speed arrester, such that as the vehicle wheels pass down the arrester back side when an automotive vehicle drives over it, the resiliency provides a forward thrust to the vehicle which can be sensed by the vehicle occupants.

5 Claims, 4 Drawing Figures

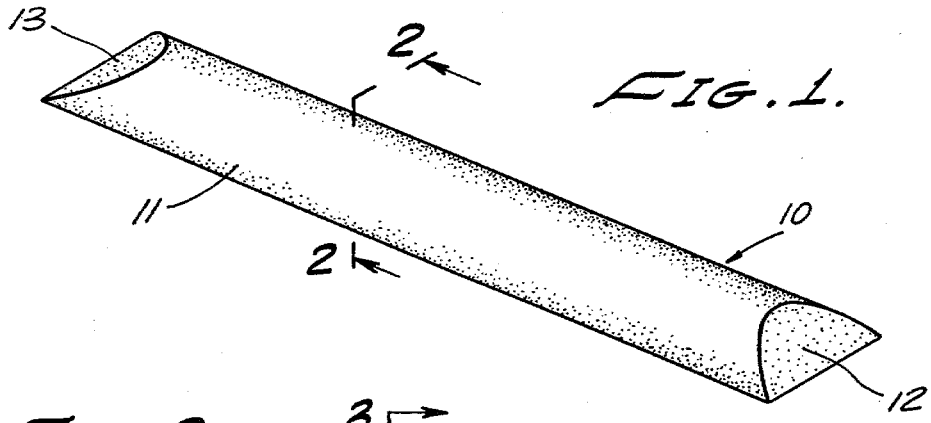
FIG. 1.
FIG. 2.
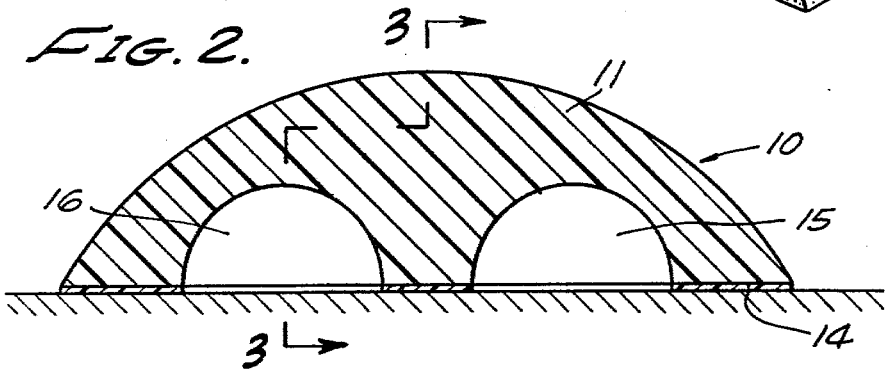
FIG. 3.
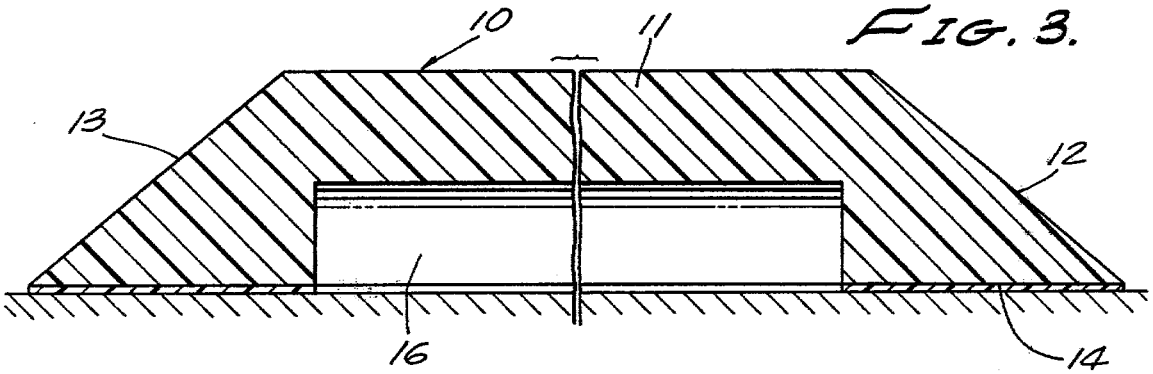
FIG. 4.
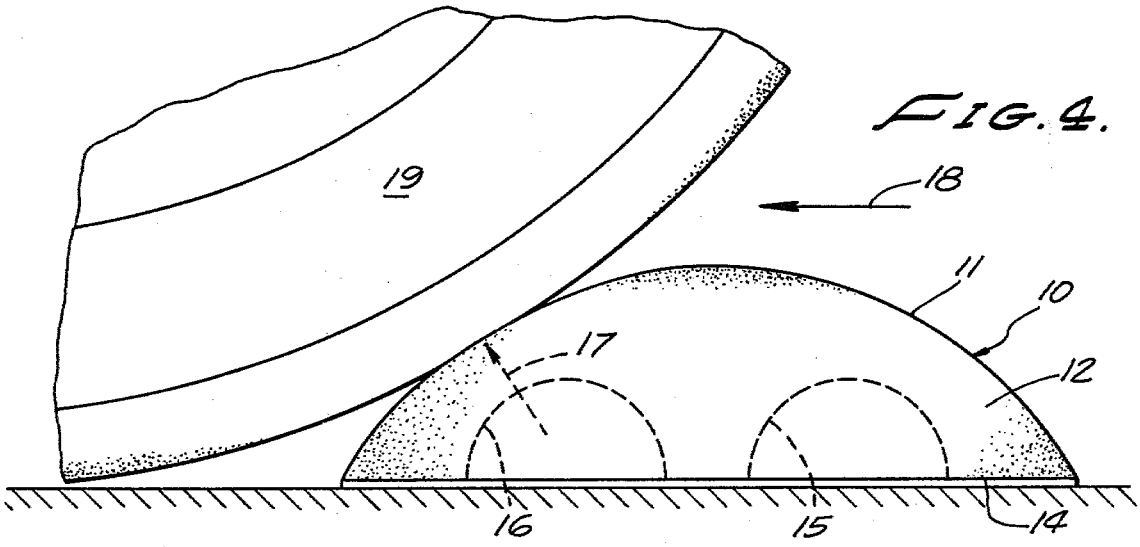

AUTOMOTIVE VEHICLE SPEED ARRESTOR

The present invention relates to an automotive vehicle speed arrester, and, more particularly, to an improved form and construction of such an improved speed arrester which is relatively inexpensive to manufacture and easy to install.

PRIOR ART AND SUMMARY

Speed arresters or speed bumps have been in use for some time in parking lot facilities, and in streets where it is desired that automotive vehicles passing therealong should not exceed a velocity of, say, approximately ten miles per hour. In the past, these have been constructed of concrete, asphalt, tarmac or other usual road material in the general form of an enlarged ridge extending across the roadway, such that an automobile moving therealong must pass over it, and if it exceeds a low threshold velocity, the automobile and its occupants will experience a severe jolt.

In the past, these bumps have been frequently made at the time the roadway itself was made and the same materials composing the roadway surface were used to provide the speed arrester or bump. In other cases, where the speed arrester was contemplated for installation after roadway was constructed, the arresters were separately constructed and installed by drilling holes into the roadway surface and secured by means of studs or threaded members to the roadway surface. In this latter case, they were usually constructed remotely from the installation site and requiring transportation of a relatively heavy and bulky item to the site, and, of course, also requiring additional labor for the installation. As for building them as an integral part of the roadway, this not only requires forethought, but also raises the problem that in the event the speed bump is not desired at a later time, it is rather difficult to remove.

A speed arrester in accordance with the practice of this invention is constructed of an elongated member having a generally semi-circular cross-section. The arrester also has a lower flat surface which is secured to the roadway, parking lot or other surface to be protected by means of a suitable adhesive material. The item is molded from a plastic having substantial rigidity and yet being capable of withstanding repeated flexing from automotive vehicles passing thereover and returning to its original shape. The speed arrester body includes a pair of elongated open channels which act to increase the resiliency of the speed arrester, such that as the vehicle wheels pass down the arrester back side when an automotive vehicle drives over it, the resiliency provides a forward thrust to the vehicle which can be sensed by the occupants.

DESCRIPTION OF THE DRAWING

FIG. 1 is a perspective view of the speed arrester of this invention.

FIG. 2 is a sectional, end elevational view, taken along line 2—2 of FIG. 1.

FIG. 3 is a side elevational, sectional view, taken along line 3—3 of FIG. 2.

FIG. 4 is a schematic, partially fragmentary depiction showing the wheel of an automotive vehicle passing over the speed arrester of FIG. 1.

DESCRIPTION OF A PREFERRED EMBODIMENT

A speed arrester, or speed bump, is essentially an elongated member attached to a road surface which extends beyond the surface of the roadway for engaging the wheels of an automotive vehicle passing thereover and causing the vehicle to experience a jolt, reminding the driver to keep his speed below some predetermined low level, which, for most practical purposes will be less than ten miles per hour. That is, it is the purpose of the speed bump to signal the driver of the automotive vehicle in a manner proportional generally to the speed with which he passes the arrester, i.e., the faster he is moving the greater the jolt. The dimensions and reaction of the speed arrester are important in that if the arrester is too high, it cannot be traversed even at a low rate of speed without discomfort to the occupants, which, of course, is undesirable. On the other hand, if it is too low, so that even though it can be felt, it does not inconvenience the driver and occupants, when the vehicle traverses at an excessive rate of speed, then it will fail as a deterrent.

As will be described below, the speed arrester of this invention not only provides the sensation of a jolt to the occupants of the vehicle, it also provides a forward surge to the vehicle which can be readily sensed by the individuals riding in the vehicle.

With reference now particularly to FIGS. 1–3 of the drawing, the speed arrester or speed bump of the invention is identified generally as at 10, and is seen to consist of a one-piece body construction 11. In geometry, the speed arrester is an elongated member of generally semi-circular cross-section (FIG. 2), the ends of which are tapered as at 12 and 13. In plan projection, the speed arrester is rectangular and has a flat, planar lower surface 14, via which it is attached to the roadway. A pair of elongated, parallel, semi-cylindrical in cross-section channels 15 and 16 extend longitudinally through the body member of the arrester throughout substantially its entire length, which channels open outwardly of the body 11 at the flat mounting surface 14. Specifically, the elongated channels 15 and 16 extend from just short of the tapered portions 12 and 13 throughout the complete central section as shown best in FIG. 3.

Although other materials may be found satisfactory, to date the speed arrester or speed bump 10 has been found best molded from elastomeric plastic, which not only is sufficiently rugged for the purpose of its ultimate use, in that it can withstand repeated flexing without deterioration, but has physical properties of resiliency to provide a counterforce to the wheels of an automobile passing thereover as the wheels move down the off side of the arrester. Additionally, the elongated empty channels 15 and 16 provide the speed arrester with a certain amount of additional resiliency, such that, as the wheels of an automotive vehicle traverse the speed arrester, it will compress substantially under the wheels due to the load of the vehicle, and, as the wheels move off the arrester as shown in FIG. 4, the arrester provides a counterforce, shown by the small arrow 17 against the wheel, which can be felt by the driver and the occupants. The direction of movement of the vehicle in FIG. 4 is indicated by the arrow 18.

A practical construction of the invention molded from the above referenced synthetic plastic material had a width of 8 inches (20.32 centimeters), a maximum height of 2.25 inches (5.72 centimeters). In operation, it gave a substantial jolt as well as upward and forward arrest readily sensed by occupants of an automotive vehicle passing thereover in excess of 10 mph and thereby served its basic function. At lower speeds (e.g, 5 mph) occupants of a vehicle passing thereover will receive a lesser jolt, but in comparison, the upward and forward thrust sensed is relatively large.

I claim:

1. An automotive vehicle speed arrester for securement to a roadway over which automotive vehicles pass, comprising:

an elongated body member having a flat surface for securement to the roadway defining an edge margin of said member and a portion extending along the member longitudinal axis, and a second surface, curved transversely about the body longitudinal axis, convexly away from said flat surface; and an adhesive material securing the body member flat surface to the roadway;

said body member being constructed of a resilient material such that on an automotive vehicle passing thereover, said member is first compressingly deformed and then as the vehicle moves off the arrester, the body member reassumes its shape, thereby exerting a force against the vehicle which is sensed by vehicle occupants.

2. An automotive vehicle speed arrester as in claim 1, in which the body member is constructed of a molded synthetic plastic material.

3. An automotive vehicle speed arrester as in either of claims 1 or 2, in which a pair of elongated openings extend longitudinally within the body member separating the flat surface edge margin and portion extending along the member longitudinal axis.

4. An automotive vehicle speed arrester as in claims 1 or 2, in which the body member has a transverse width of approximately 20 centimeters and a maximum height of not less than about 6 centimeters nor more than about 9 centimeters.

5. A speed bump for securement to a roadway surface over which automotive vehicles pass, comprising:

an elongated body member having a generally rectangular flat mounting surface and a second surface upwardly disposed when installed on the roadway, said second surface being convexly upwardly curved about a body member longitudinal axis;

a quantity of adhesive securing the body member flat surface to the roadway surface;

said body member being constructed of molded synthetic plastic and including a pair of spaced, generally parallel, longitudinally extending channel-like openings a part of which openings interrupt the mounting surface, the synthetic plastic being sufficiently resilient to compressingly deform on a vehicle passing thereover and on recovering its original shape providing a thrust to the vehicle which is upward and in the direction of movement of the vehicle.

* * * * *